US005132006A

United States Patent [19]

Neumann et al.

[11] Patent Number: 5,132,006

[45] Date of Patent: Jul. 21, 1992

[54] LIQUID DEHALOGENATING AGENTS

[75] Inventors: Manfred Neumann, Marl; Heinz-Werner Voges, Dorsten, both of Fed. Rep. of Germany

[73] Assignee: Huels Aktiengesellschaft, Marl, Fed. Rep. of Germany

[21] Appl. No.: 431,437

[22] Filed: Nov. 3, 1989

[30] Foreign Application Priority Data

Feb. 2, 1989 [DE] Fed. Rep. of Germany ..... 3903105

[51] Int. Cl.[5] ..... C10G 17/00

[52] U.S. Cl. ..... 208/262.1; 252/9; 252/42.7; 252/182.12

[58] Field of Search ..... 252/42.7, 182.12, 9; 208/262.1

[56] References Cited

U.S. PATENT DOCUMENTS 4,351,718 9/1982 Brunelle ..... 208/262.1
4,532,028 7/1985 Peterson ..... 208/262.1
4,776,947 10/1988 Streck et al. ..... 208/262.1
5,057,207 10/1991 Basler ..... 208/262.1

*Primary Examiner*—Jacqueline Howard
*Attorney, Agent, or Firm*—Oblon, Spivak, McClelland, Maier & Neustadt

[57] ABSTRACT

Liquid dehalogenating agents containing (a) 30 to 70% by weight of an alkali metal alcoholate having 6 to 20 carbon atoms; (b) up to 12% by weight of an alcohol having 6 to 20 carbon atoms; (c) 5 to 40% by weight of a polyether; and (d) 10 to 65% by weight of a halogen-free hydrocarbon oil are efficient for the dehalogenation of waste oil while at the same time exhibiting improved resistance to hydrolysis and oxidation. In addition the present dehalogenating agents are homogeneous, stable for storage at room temperature, pumpable, and readily measurable, and they may be used in unheated pipes and pumps without causing deposits or plugging.

13 Claims, No Drawings

LIQUID DEHALOGENATING AGENTS

BACKGROUND OF THE INVENTION

1. Field of the Invention

The present invention relates to liquid dehalogenating agents based on alkali metal alcoholates (alkoxides), the preparation of such dehalogenating agents, and the use of these dehalogenating agents for the dehalogenation of waste oils.

2. Discussion of the Background

Lubricating oils concentrate metallic dross and degradation and oxidation products of their constituents during use. Nevertheless, used lubricating oils are not considered to be waste products since they can be processed by filtration, distillation, or refining with concentrated sulfuric produced after replenishment of additives. However, contamination from chlorinated hydrocarbons, such as polychlorinated biphenyls (PCBs), for example, that are objectionable from the toxicological viewpoint, are not removed in this way.

It is known that contamination from organic halogen compounds in waste oils can be removed by treatment with alkali metal alcoholates. Thus, according to EP-B-21,294, alkali metal alcoholates of alcohols with 1 to 5 carbon atoms, polyoxyalkylene glycols with 4 to 20 carbon atoms, polyols with 2 to 5 carbon atoms and 2 to 3 hydroxyl groups, or of monoalkyl ethers of these polyols with alcohols with 1 to 4 carbon atoms, are disclosed as dehalogenating agents. The reaction is carried out in the presence of one-half to one equivalent of the related free alcohol. Dehalogenation is preferably carried out with sodium glycolate/ethylene glycol and with sodium methylate/methanol.

In DE-A-36 21 175, the dehalogenation of hydrocarbon oils is carried out with alkali metal alcoholates with 6 to 25 carbon atoms at 120 to 400° C. The alcoholates in this case can contain small amounts of the related alcohol.

The known alcoholate dehalogenating agents are particularly sensitive to oxidation and hydrolysis at elevated temperatures. They also become solid or deposit solid constituents while cooling to room temperature. To avoid deposits, they have to be fed through heated pipes and pumps. In addition, they always have to be stored hot until they are used as intended.

SUMMARY OF THE INVENTION

Accordingly, it is an object of the present invention to provide easily handled dehalogenating agents that are also less sensitive to oxidation and hydrolysis.

It is another object of the present invention to provide a process for the preparation of dehalogenating agents.

It is another object of the present invention to provide a method for the dehalogenation of contaminated oils.

These and other objects, which will become apparent during the course of the following detailed description, have been achieved by liquid dehalogenating agents that contain the following constituents:

(a) 30 to 70% by weight of an alkali metal alcoholate having 6 to 20 carbon atoms;

(b) up to 12% by weight of an alcohol having 6 to 20 carbon atoms;

(c) 5 to 40% by weight of a polyether having the formula (I):

$$R_1-O-(\underset{\underset{R_2}{|}}{CH}-CH_2-O)_n-X, \quad (I)$$

in which $R_1$ is hydrogen or alkyl having 1 to 15 carbon atoms, $R_2$ is hydrogen or alkyl having 1 to 5 carbon atoms, X is hydrogen or alkyl having 1 to 5 carbon atoms, and n is an integer of 2 to 50; and (d) 10 to 65% by weight of a halogen-free hydrocarbon oil, in which the % by weight values for the amounts of (a)-(d) are based on the sum of the weights of (a)-(d).

DETAILED DESCRIPTION OF THE PREFERRED EMBODIMENTS

Thus, the present dehalogenating agents contain 30 to 70% by weight of an alkali metal alcoholate, up to 12% by weight of an alcohol, 5 to 40% by weight of the polyether having formula (I), and 10 to 65% by weight of a halogen-free hydrocarbon oil.

The dehalogenating agents that are liquid even at room temperature preferably contain 40 to 60% by weight of an alkali metal alcoholate, up to 10% by weight of the related alcohol, 5 to 30% by weight of a polyether having the formula (I); and 20 to 55% by weight of a halogen-free hydrocarbon oil, in which the term related alcohol refers to the same alcohol from which the alcoholate is obtained by replacing the hydroxy hydrogen with an alkali metal.

Examples of the alcohols on which the alcoholates are based include hexanol, octanol, 2-ethylhexanol, decanol, 3,4-diethylhexanol, 2,4,6-trimethyloctanol, dodecanol, tetradecanol, hexadecanol, or octadecanol. The alcoholates preferably contain from 8 to 14 carbon atoms. Alcoholates of 2-ethyl-1-hexanol are very particularly preferred.

Sodium and potassium alcoholates are preferably used as alkali metal alcoholates.

The alkali metal alcoholates can be prepared by any conventional process. Thus, for example, alkali metal can be reacted with alcohol, alkali metal hydroxide with alcohol, or a lower alcoholate with a higher alcohol, with the last-mentioned reaction (salt interchange) occurring above about 220° C. at an adequate rate.

The alkali metal alcoholate can contain small amounts of related free alcohol from the preparation.

Polyalkylene oxide glycols and their mono- and dialkyl ethers are used as polyethers of formula (I). Mono- and dialkyl ethers of polyethylene oxide and polypropylene oxide glycols are preferably used. Alkyl ethers of copolymers of ethylene oxide and propylene oxide are also suitable.

In formula (I), $R_1$, for example, is hydrogen, methyl, ethyl, propyl, isopropyl, butyl, hexyl, octyl, decyl, dodecyl, or tetradecyl. $R_1$ is preferably alkyl having 1 to 8 carbon atoms.

The degree of polymerization, n, is preferably 3 to 15.

In a particularly preferred embodiment, the polyethers are monobutyl ethers of polyethylene oxide or polypropylene oxide glycols with a degree of polymerization, n, of 3 to 6.

The polyethers used generally have a boiling point above 200° C.

Examples of suitable halogen-free hydrocarbons are saturated paraffins, lubricating and insulating oils, and neutral oils based on paraffins, aromatics, and naphthenes.

To prepare the liquid dehalogenating agents, the alkali metal alcoholate, which may contain small amounts of alcohol, is first dissolved at 100 to 200° C. in a polyether of formula (I). The dissolving process usually occurs spontaneously. It is complete after 15 minutes at the most. The dissolving takes place too slowly at temperatures below 100° C. At temperatures above 200° C., when using polyalkylene oxide glycols and their monoalkyl ethers, there is the danger that salt interchange will take place to a significant extent. Free alcohol and alkali metal salt of the polyether would then be formed.

The alkali metal alcoholate is preferably dissolved in the polyether at a temperature of 160° C. to 200° C.

The halogen-free hydrocarbon oil is then admixed. A temperature of 30 to 200° C. is generally used here, with 100 to 160° C. being preferred.

In the preparation of the liquid dehalogenating agents, the quantities are chosen so that mixtures with the aforementioned proportions are produced.

Waste oils can be dehalogenated with these products that are liquid at room temperatures. The dehalogenation generally occurs at 200 to 400° C., with 0.5 to 10 moles of alkali metal alcoholate preferably being used per mole of halogen in the waste oil.

Hydrocarbon oil and polyether are essential for the dehalogenating agents of the present invention. The alkali metal alcoholate would not be soluble at room temperature in just the hydrocarbon oil; it could also not be stored without sedimentation. Dissolved in the polyether alone, the alkali metal alcoholate would not be sufficiently resistant to oxidation and hydrolysis. By the combination of polyether and hydrocarbon oil in which the polyether also acts as a solubilizer, liquid dehalogenating agents are obtained with the following properties:

- improved resistance to hydrolysis and oxidation,
- homogeneous and non-settling at room temperature, and therefore stable in storage,
- liquid, pumpable, readily measurable, the products can remain in unheated pipes and pumps without causing deposits or plugging.

Having generally described the present invention, a further understanding can be obtained by reference to certain specific examples which are provided herein for purposes of illustration only and are not intended to be limiting unless otherwise specified.

EXAMPLES

Example 1

A mixture of 211.3 g of sodium ethylhexylate (sodium salt of 2-ethyl-1-hexanol) and 6.2 g of 2-ethyl-1-hexanol, prepared from sodium methylate and 2-ethyl-1-hexanol, is treated with 88 g of tetraethylene glycol monobutyl ether at 190° C., with a homogeneous solution being formed with stirring in 10 minutes. 131.5 g of neutral oil (2.5° E/50) is then added slowly at 130° C., after which the mixture is cooled to room temperature with stirring. A clear dehalogenating reagent with a viscosity of 840 mPa s at 20° C. is obtained.

Composition 48.4% sodium ethylhexylate
1.4% 2-ethyl-1-hexanol
20.1% Bu-O-$(C_2H_4O)_4$—H
30.1% neutral oil 20 g of this dehalogenating reagent is treated with 200 ml of diethyl ether and the mixture is stirred for 30 minutes at room temperature. It is then filtered through silica gel (slurried with diethyl ether) and the filter cake is washed with diethyl ether. From the eluate, after distillation of the diethyl ether, is obtained 10.3 g of high-boiling residue that consists of neutral oil, tetraethylene glycol monobutyl ether, and a few percent of 2-ethyl-1-hexanol.

During the hydrolysis of the filter cake with water, two phases are formed, with the upper phase consisting of 2-ethyl-1-hexanol and the lower phase being a sodium hydroxide solution saturated with 2-ethyl-1-hexanol.

This test shows that tetraethylene glycol monobutyl ether is not present as a salt, and therefore that no salt interchange has taken place.

Example 2

211.3 g of sodium ethylhexylate and 9.2 g of 2-ethyl-1-hexanol are treated at 170° C. with 85 g of triethylene glycol dimethyl ether. After 10 minutes, the solution is clear. 128 g of neutral oil (2.5° E/50) is then added at 120° C., after which the mixture is cooled to room temperature with stirring. A reagent that is easily poured at room temperature is obtained, with the composition:

48.8% sodium ethylhexylate
2.1% 2-ethyl-1-hexanol
19.6% Me—O—$(C_2H_4O)_3$—Me
29.5% neutral oil

Example 3

211.3 g of sodium ethylhexylate and 21.9 g of 2-ethyl-1-hexanol are treated at 190° C. with 84 g of tetraethylene glycol monobutyl ether, and after obtaining a homogeneous solution, 100 g of neutral oil (2.5°E/50) is added at 150° C., after which the mixture is cooled to room temperature. The dehalogenating reagent has a viscosity of 820 mPa s at 20° C. and has the following composition:

50.6 sodium ethylhexylate
5.3% 2-ethyl-1-hexanol
20.1% Bu—O—$(C_2H_4O)_4$—H
24.0% neutral oil Example 4

250.4 g of sodium decanolate (sodium salt of decanol) and 27.7 g of 1-decanol are treated at 200° C. with 113 g of tetraethylene glycol monobutyl ether. A clear solution has formed within 10 minutes. 142 g of high-naphthene neutral oil is added at 140° C., and the mixture is cooled to room temperature with stirring. The mixture which can be poured easily at 25° C. has the composition:

47.0% sodium decanolate
5.2% 1-decanol
21.2% Bu—O—$(C_2H_4O)_4$—H
26.6% neutral oil

Example 5

Dehalogenation 100 g of waste oil with the contents of chlorine specified in Table 1 is dechlorinated at 300° C. or 330° C. in 30 or 60 minutes. The dehalogenating agent of Example 1 is used in Experiments 1 to 3, and the dehalogenating agent of Example 2 is used in Experiments 4 and 5. The results are given in Table 1.

TABLE 1

| Experiment | Molar Ratio of sodium ethylhexylate to halogen | T (°C.) | ppm Cl in oil Before dehalogenation | After 30 min. | After 60 min. |
|---|---|---|---|---|---|
| 1 | 4.2 | 300 | 500 | 210 | — |
| 2 | 4.2 | 330 | 500 | 80 | — |
| 3 | 8.4 | 300 | 500 | — | 190 |
| 4 | 6.4 | 330 | 500 | 95 | |
| 5 | 0.95 | 300 | 4,400 | — | 530 |

The results presented in Table 1 demonstrate that the liquid dehalogenation agents of the present invention are very suitable as dehalogenating agents.

Obviously, numerous modifications and variations of the present invention are possible in light of the above teachings. It is therefore to be understood that within the scope of the appended claims, the invention may be practiced otherwise than as specifically described herein.

What is new and desired to be secured by letters patent of the United States is:

1. A liquid dehalogenating agent, comprising:

(a) 30 to 70% by weight of an alkali metal alcoholate having 6 to 20 carbon atoms;

(b) up to 12% by weight of an alcohol having 6 to 20 carbon atoms;

(c) 5 to 40% by weight of a compound having the formula (I)

$$R_1-O-(\underset{\underset{R_2}{|}}{CH}-CH_2-O)_n-X, \quad (I)$$

wherein $R_1$ is hydrogen or alkyl having 1 to 15 carbon atoms, $R_2$ is hydrogen or alkyl having 1 to 5 carbon atoms, X is hydrogen or alkyl having 1 to 5 carbon atoms, and n is an integer of 2 to 50; and (d) 10 to 65% by weight of a halogen-free hydrocarbon oil, wherein the % by weight values for (a) to (d) are based on the sum of the weights of (a) to (d).

2. The liquid dehalogenating agent of claim 1, comprising (a) 40 to 60% by weight of said alkali metal alcoholate;

(b) up to 10% by weight of said alcohol;

(c) 5 to 30% by weight of said compound having the formula (I); and (d) 20 to 55% by weight of said halogen-free hydrocarbon oil.

3. The liquid dehalogenating agent of claim 1, wherein said alkali metal alcoholate and said alcohol each have 8 to 14 carbon atoms and said alkali metal is one or more metals selected from the group consisting of sodium and potassium.

4. The liquid dehalogenating agent of claim 1, wherein in said compound of formula (I), $R_1$ is alkyl having 1 to 8 carbon atoms, $R_2$ is H or methyl, X is H or methyl, and n is an integer of 3 to 15.

5. The liquid dehalogenating agent of claim 1, wherein said alkali metal alcoholate is obtained by replacing the hydroxy hydrogen of said alcohol with an alkali metal.

6. The liquid dehalogenating agent of claim 5, wherein said alcohol is selected from the group consisting of hexanol, octanol, 2-ethylhexanol, decanol, 3,4-diethylhexanol, 2,4,6-trimethyloctanol, dodecanol, tetradecanol, hexadecanol, and octadecanol.

7. The liquid dehalogenating agent of claim 5, wherein said alcohol is 2-ethyl-1-hexanol.

8. A process for preparing a liquid dehalogenating agent, comprising the steps:

(i) dissolving 30 to 70 parts by weight of an alkali metal alcoholate having 6 to 20 carbon atoms and up to 12 parts by weight of an alcohol having 6 to 20 carbon atoms in 5 to 40 parts by weight of a compound having the formula (I)

$$R_1-O-(\underset{\underset{R_2}{|}}{CH}-CH_2-O)_n-X, \quad (I)$$

wherein $R_1$ is hydrogen or alkyl having 1 to 15 carbon atoms, $R_2$ is hydrogen or alkyl having 1 to 5 carbon atoms, X is hydrogen or alkyl having 1 to 5 carbon atoms, and n is an integer of 2 to 50, at a temperature of 100 to 200° C., to obtain a solution; and (ii) adding 10 to 65 parts by weight of a halogen-free hydrocarbon oil to said solution, wherein the sum of the parts by weight of said alkali metal alcoholate, said alcohol, said polyether, and said oil equals 100 parts.

9. The process of claim 8, wherein said dissolving is carried out at a temperature of 160° to 200° C.

10. The process of claim 8, wherein said adding is carried out at a temperature of 30 to 200° C.

11. The process of claim 10, wherein said adding is carried out at a temperature of 100 to 160° C.

12. A method for dehalogenating oil contaminated with halogen, comprising:

(i) contacting, at a temperature of 200 to 400° C., said oil with a liquid dehalogenating agent, comprising:

(a) 30 to 70% by weight of an alkali metal alcoholate having 6 to 20 carbon atoms;

(b) up to 12% by weight of an alcohol having 6 to 20 carbon atoms;

(c) 5 to 40% by weight of a compound having the formula (I)

$$R_1-O-(\underset{\underset{R_2}{|}}{CH}-CH_2-O)_n-X, \quad (I)$$

wherein Ris hydrogen or alkyl having 1 to 15 carbon atoms, $R_2$ is hydrogen or alkyl having 1 to 5 carbon atoms, X is hydrogen or alkyl having 1 to 5 carbon atoms, and n is an integer of 2 to 50; and (d) 10 to 65% by weight of a halogen-free hydrocarbon oil, wherein the % by weight values for (a) to (d) are based on the sum of the weights of (a) to (d).

13. The method of claim 12, wherein the relative amounts of said dehalogenating agent and said oil are such that there is 0.5 to 10 moles of said alkali metal alcoholate per mole of said halogen.

* * * * *